US006808573B2

(12) United States Patent
Hales et al.

(10) Patent No.: US 6,808,573 B2
(45) Date of Patent: Oct. 26, 2004

(54) EMULSION PHASE HAVING IMPROVED STABILITY

(75) Inventors: Richard H. Hales, West Jordan, UT (US); Don H. Cranney, South Jordan, UT (US); Eldon K. Hurley, Kingston, NY (US); Scott B. Preston, Colorado Springs, CO (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 10/252,171

(22) Filed: Sep. 23, 2002

(65) Prior Publication Data

US 2004/0055678 A1 Mar. 25, 2004

(51) Int. Cl.[7] ..... C06B 21/00
(52) U.S. Cl. ..... 149/109.6; 149/2; 149/46
(58) Field of Search ..... 149/109.6, 2, 46

(56) References Cited

U.S. PATENT DOCUMENTS

| | | | | | |
|---|---|---|---|---|---|
| 4,287,010 | A | * | 9/1981 | Owen, II | 149/2 |
| 4,523,967 | A | * | 6/1985 | Cartwright | 149/2 |
| 4,615,752 | A | | 10/1986 | Miller | |
| 4,820,361 | A | | 4/1989 | McKenzie et al. | |
| 4,836,870 | A | * | 6/1989 | Cunningham et al. | 149/109.6 |
| 4,844,756 | A | * | 7/1989 | Forsberg | 149/46 |
| 4,931,110 | A | | 6/1990 | McKenzie et al. | |
| 5,084,117 | A | * | 1/1992 | Houston et al. | 149/109.6 |
| 5,322,576 | A | | 6/1994 | Aitken et al. | |
| 5,834,539 | A | * | 11/1998 | Krivohlavek | 149/118 |

* cited by examiner

*Primary Examiner*—Edward A. Miller

(57) ABSTRACT

A method is disclosed for forming a stable, water-in-oil emulsion phase containing a polymeric emulsifier. The addition of an animal oil or fatty acid additive enhances the long-term stability of the emulsion phase following homogenization.

10 Claims, No Drawings

EMULSION PHASE HAVING IMPROVED STABILITY

The present invention comprises a method for forming a stable, polymeric emulsifier-based, water-in-oil emulsion phase having improved stability following homogenization.

BACKGROUND

Water-in-oil emulsion explosives, hereafter termed "emulsion explosives," are well-known in the industry. They comprise an emulsified dispersion of a discontinuous phase of inorganic oxidizer salt solution droplets in a continuous organic fuel phase. This dispersion or emulsion phase is held in place by a water-in-oil emulsifier (hereafter "emulsifier") provided the emulsified state remains stable. The inorganic oxidizer salt solution droplets typically are in a super-cooled state and thus want to crystallize and consequently destabilize the emulsified state. Thus if the emulsified state weakens, the emulsion will destabilize and the salts in the droplets will crystallize, causing further destabilization. This crystallization desensitizes the emulsion explosive and can render it undetonable.

Destabilization is a common problem when the emulsion explosive is subjected to "working" or is "worked," which means to subject the emulsion phase to shearing action such as when the emulsion phase is pumped or otherwise transferred into a borehole or other container or is mixed with additional ingredients such as sensitizing microballoons or AN prills. In explosives applications, an emulsion phase is commonly subjected to working in this fashion and thus the emulsion phase must be able to retain its stability even after working. The formulations disclosed herein have greater stability when subjected to these normal processing and handling conditions. In addition to these common transfer and mixing operations, an emulsion phase may purposely be subjected to very high shear conditions by various means in order to increase the viscosity of the emulsion phase. This process is commonly (and herein) referred to as homogenization. As homogenization occurs, the dispersed oxidizer salt solution droplets become smaller in size and consequently the viscosity of the emulsion phase increases. This viscosity increase oftentimes is desirable because it enables the emulsion explosive to resist water intrusion, retain its stability and remain in the borehole rather than flowing out of an upwardly extending borehole or into cracks or fissures. Along with the viscosity increase and smaller solution droplet size that result from homogenization, however, the propensity of the emulsion phase to experience crystallization increases under such high shear conditions. Thus, for a given composition there is a practical limit to the degree of homogenization that can occur before crystallization becomes unacceptable.

Although polymeric emulsifiers, such as those based on various adducts of polyisobutenyl succinic anhydride ("PIBSA"), are found to form stable emulsion phases under certain conditions, emulsion phases containing polymeric emulsifiers tend to destabilize upon homogenization. Efforts at inhibiting such destabilization include replacing a portion of the polymeric emulsifier with nonpolymeric emulsifiers that are less susceptible to homogenization destabilization such as sorbitan monooleate (SMO). The nonpolymeric emulsifiers, however, tend to form emulsion phases that are less stable with time than those formed with primarily or solely polymeric emulsifiers, both before and after homogenization. Thus, where mixtures of polymeric and nonpolymeric emulsifiers were used, both stability and homogenizeability were compromised to a degree. The present invention allows an emulsion phase to be formed that is both stable and homogenizeable.

One method for homogenizing emulsion explosives is disclosed in U.S. Pat. No. 4,615,752, which involves positioning a valve at the end of a delivery hose in order to increase the viscosity of the explosive through the shearing action of the valve. In addition, in-line mixing devices to impart high shear to an emulsion during flow (pumping) are used in the industry, and these can be positioned anywhere within the delivery train of the emulsion. Another method for improving homogenization is disclosed in U.S. Pat. No. 5,322,576, which discloses replacing at least a portion of the organic fuel phase with a vegetable oil.

SUMMARY

The method of the present invention for forming a stable, polymeric emulsifier-based emulsion phase following homogenization comprises:

(a) forming an inorganic oxidizer salt solution, (b) forming an organic fuel phase which comprises at least about 3% by weight of the fuel phase of an homogenization additive selected from the group consisting of animal oils and fatty acids, (c) mixing the organic fuel phase and the inorganic oxidizer salt solution phase in the presence of a polymeric emulsifier with sufficient shear to form the emulsion phase, and then, (d) homogenizing the emulsion phase to increase its viscosity prior to placement or packaging of the product.

The use of an homogenization additive selected from the group consisting of animal oils and fatty acids in an amount of at least about 3% by weight of the organic fuel phase has been found to improve the long-term stability of a homogenized emulsion phase that contains a polymeric emulsifier. In test results shown in the tables below, this stability improvement surprisingly is better than that provided by an organic fuel phase that contains a vegetable oil.

DETAILED DESCRIPTION

The method of the present invention involves forming a water-in-oil emulsion phase that comprises a continuous phase of organic liquid fuel, an emulsifier and a discontinuous phase or inorganic oxidizer salt solution. A homogenizing additive is added and other additives may be present as described below.

The organic liquid fuel forming the continuous phase of the emulsion phase is immiscible with water and is present in an amount of from about 3% to about 12%, and preferably in an amount of from about 4% to about 8% by weight of the emulsion phase. The actual amount used can be varied depending upon the particular immiscible fuel(s) used and upon the presence of other fuels, if any. The immiscible organic liquid fuels can be aliphatic, alicyclic, and/or aromatic and can be saturated and/or unsaturated, so long as they are liquid at the formulation temperature. Preferred fuels include mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitro-compounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight. If desired, undissolved oxidizer salt can be added to the composition along with any solid or liquid fuels.

The inorganic oxidizer salt solution forming the discontinuous phase of the emulsion phase generally comprises inorganic oxidizer salt, in an amount from about 45% to about 95% by weight of the emulsion phase, and water and/or water-miscible organic liquids, in an amount of from about 0% to about 30%. The oxidizer salt preferably is primarily ammonium nitrate (AN), but other salts may be used in amounts up to about 50% of the total salts. The other oxidizer salts are selected from the group consisting of ammonium, alkali and alkaline earth metal nitrates, chlorates and perchlorates. Of these, sodium nitrate (SN) and calcium nitrate (CN) are preferred. AN and ANFO prills also can be added in solid form as part of the oxidizer salt in the final composition.

Water generally is employed in an amount of from 3% to about 30% by weight of the emulsion phase. It is commonly employed in emulsions in an amount of from about 5% to about 20%, although emulsions can be formulated that are essentially devoid of water.

Water-miscible organic liquids can at least partially replace water as a solvent for the salts, and such liquids also function as a fuel for the composition. Moreover, certain organic compounds also reduce the crystallization temperature of the oxidizer salts in solution. Soluble or miscible solid or liquid fuels can include alcohols such as methyl alcohol, glycols such as ethylene glycols, polyols such as sugars, amides such as formamide, amines, amine nitrates, urea and analogous nitrogen-containing fuels. As is well known in the art, the amount and type of water-miscible liquid(s) or solid(s) used can vary according to desired physical properties.

A polymeric emulsifier is used in forming the emulsion and typically is present in an amount of from about 0.2% to about 5% by weight of the emulsion phase. Polymeric water-in-oil emulsifiers are molecules which have a polymeric hydrophobic portion and a polar moiety that serves as the hydrophilic portion. The polymer can be derived from any of a number of monomers such as ethylene, propylene, and isobutene. The hydrophilic moiety can be any polar moiety which is attracted to water or ionic solutions of water such as carboxyl groups, esters, amides, and imides. U.S. Pat. No. 4,820,361 describes a polymeric emulsifier derivatized from trishydroxymethylaminomethane and polyisobutenyl succinic anhydride ("PIBSA"), which is particularly effective in combination with organic microspheres and is a preferred emulsifier. Other derivatives of polypropene or polybutene have been disclosed. Preferably the polymeric emulsifier comprises polymeric amines and their salts or an amine, alkanolamine or polyol derivative of a carboxylated or anhydride derivatized olefinic or vinyl addition polymer. U.S. Pat. No. 4,931,110 discloses a polymeric emulsifier comprising a bis-alkanolamine or bis-polyol derivative or a bis-carboxylated or anhydride derivatized olefinic or vinyl addition polymer in which the olefinic or vinyl addition polymer chain has an average chain length of from about 10 to about 32 carbon atoms, excluding side chains or branching.

Polymeric emulsifiers are known to give excellent shelf-life to emulsion explosives due to enhanced steric stabilization effected by the hydrophobic portion of the molecules, as compared to conventional water-in-oil emulsifiers such as sorbitan monooleate. However, attempts to homogenize polymeric emulsifier-based emulsions generally causes significant crystallization to occur. As previously mentioned, shorter chained water-in-oil emulsifiers such as sorbitan monooleate have been included in the emulsion to improve homogenizeability. These emulsifiers, however, negatively affect the shelf-life or long-term stability of the emulsion phase both before and after homogenization.

The present invention greatly enhances the ability of a polymeric emulsifier-based emulsion explosive to undergo significant, purposeful homogenization without also undergoing crystallization of the super-cooled internal phase and consequent loss of detonation properties. This is accomplished by adding an homogenization additive to the continuous phase of the emulsion phase to prevent or minimize crystallization during homogenization. The additive is selected from the group consisting of animal oils and fatty acids. The animal oils are rendered from animal fats and preferably are selected from the group consisting of lard oil, tallow oil and poultry oil. The fatty acids can be derived from a number of sources including the hydrolysis of glycerol esters, such as those found in animal oils or vegetable oils or other plant oils or extracts therefrom such as tall oils. The fatty acids can be composed of from 8 to 22 carbon atoms, usually even numbered, and preferably from 14 to 20 carbon atoms, and can be either saturated or unsaturated (olefinic) and solid, semisolid or liquid. Examples of saturated acids are palmitic and stearic acid. Examples of unsaturated acids are oleic or linoleic acid. The additives are present in the amount of from about 3% to about 40% by weight of the organic liquid fuel phase, and more preferably from about 5% to about 15% by weight of the organic liquid fuel phase.

One theory as to why the homogenization additives are effective is that they are more mobile (they diffuse or migrate more easily) than the more bulky polymeric emulsifiers. Thus, when new interfaces between the internal (oxidizer salt solution phase) and external (organic liquid fuel phase) phases are created by the high shearing action of homogenization, the more mobile animal oils or fatty acids migrate to the interface to stabilize it, thereby promoting the formation of smaller droplet sizes and also preventing crystallization of the internal phase. It is further theorized that the additives gradually are replaced by the more tightly bound (thermodynamically favored) polymeric emulsifiers which impart greater stability to the resulting product. Thus, the additives do not degrade substantially the stability of the emulsion phase either before or after homogenization as does, for example, sorbitan monooleate, which competes as an emulsifier at the droplet interface with the polymeric emulsifier molecules thereby yielding a less stable emulsion.

Homogenization that is purposely effected on an emulsion explosive generally at least doubles its viscosity and more generally increases its viscosity by 3 to 10 times or more. The homogenization of the emulsion explosive (absent any significant crystallization) also increases sensitivity, detonation velocity, column integrity in bulk loaded boreholes, the ability to stay in upwardly loaded boreholes, the stiffness of the rheology in packaged emulsions, and so on. Such properties enhance the performance and function of the emulsion explosive in many applications.

The emulsion phase of the present invention may be formulated in a conventional manner as is known in the art.

Typically, the oxidizer salt(s) first is dissolved in the water (or aqueous solution of water and miscible liquid fuel) at an elevated temperature of from about 25° C. to about 90° C. or higher, depending upon the crystallization temperature of the salt solution. The aqueous oxidizer solution then is added to a solution of the emulsifier, homogenization additive and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous oxidizer solution.) Stirring should be continued until the formulation is uniform. The formulation process also can be accomplished in a continuous manner as is known in the art.

It is advantageous to predissolve the emulsifier in the liquid organic fuel prior to combining the organic fuel with the aqueous solution to form an emulsion. This method allows the emulsion to form quickly and with minimum agitation. However, the emulsifier may be added separately as a third component if desired.

Though not required, microballoons can be added to the emulsion phase to sensitize it to initiation. The microballoons preferably are plastic microspheres having a nonpolar surface and comprising homo-, co- or terpolymers of vinyl monomers. A preferred composition of the plastic microspheres is a thermoplastic copolymer of acrylonitrile and vinylidine chloride. Additionally, the microballons may be made from siliceous (silicate-based), ceramic (aluminosilicate) glass such as soda-lime-borosilicate glass, polystyrene, perlite or mineral perlite material. Further, the surface of any of these microballoons may be modified with organic monomers or homo-, co- or terpolymers of vinyl or other monomers, or with polymers of inorganic monomers. In the emulsion phase, microballoons preferably are employed in an amount of from about 0.1% to about 1% for plastic microballoons or 1% to 6% for glass microballoons. Chemical gassing agents also can be used in the emulsion as is known in the art.

The pH of the emulsion phase preferably is from about 2 to about 7, and more preferably from about 3.5 to about 5.0. These pH ranges facilitate chemical gassing and also limit the solubility of the fatty acid (in its basic form) in the aqueous solution, thus preserving the fatty acid in its acid form, which is efficacious for purposes of this invention.

The invention can be illustrated further by reference to the following examples and tables. In the tables the following key applies: "MB" stands for minimum booster in the cylindrical diameter and with the detonator strength indicated. "D" is detonation velocity in the sizes indicated when initiated with a detonator or booster of the strength or size indicated (3C=454 grams pentolite). All detonation velocities are "unconfined" detonation velocities and hence are lower, particularly in smaller charge diameters, than would be their calculated theoretical detonation velocities.

In most examples, the emulsions were formed as described below and then allowed to cool to ambient temperature over one or more days. The emulsion phases then were subjected to homogenization and, in some cases, simultaneous chemical gassing and/or mixing with other ingredients. In some examples, the hot emulsion was formed and then immediately was homogenized and mixed with further components. In some cases the detonation properties of the resulting mixes were determined. The viscosities of the phases were measured before and after homogenization using an HA model Brookfield digital viscometer with a #7 spindle at 20 rpm. In all cases the emulsion phases or final mixes were measured for stability to crystallization using the qualitative grading scale shown in Table 1.

EXAMPLE 1

A series of emulsions were prepared by adding the oxidizer salt solution at an elevated temperature to the mixture of organic liquid fuel and homogenization additive, while stirring at 1500 rpm for two minutes with a Jiffy stirrer. The emulsions were stored at ambient temperature overnight and then subjected to high shear by passing them through an in-line adjustable shearing valve (mini-kunkle valve) at 160 psi back pressure. The emulsion temperature and viscosity were measured prior to and after homogenization. Also, samples of pre-homogenized emulsion as well as post-homogenized emulsion were stored at ambient temperature and monitored over an 18-week time period for stability (i.e. degree of crystallization). Table 2 shows these results along with the formulation for each emulsion.

Formulation 1 was made with a PIBSA-based polymeric emulsifier but with no co-emulsifier (SMO) or homogenization additive. Although this emulsion was very stable prior to being homogenized, high shear homogenization resulted in heavy crystal formation and an accompanying large temperature increase. The viscosity of the emulsion increased more than three times due to the high crystal formation. Formulations 2 through 6 contain the same ingredients except that 5% of the fuel phase consists of either a co-emulsifier or homogenization additive.

Formulation 2 illustrates the effect of SMO added to the emulsion. The addition of SMO allowed homogenization to occur without significant crystallization initially, but the pre-homogenized and post-homogenized emulsion both degraded over time. There was a small temperature rise with no crystals observed while a viscosity increase of about 3.4 times was seen. Formulations 3 and 4 show similar results with corn oil and tall oil (of only approximately 56 percent fatty acid content) added respectively.

Formulations 5 and 6 show the pronounced improvement in both pre-homogenized and post-homogenized emulsion stability when two different animal oils were added to the emulsion in amounts of 5% of the fuel phase.

EXAMPLE 2

Table 3 further illustrates the invention in emulsions made with PIBSA-based polymeric emulsifiers. Formulation 1 contained no homogenization additive, but Formulations 2 and 3 contained the animal oils shown. The emulsions were formed as in Example 1 and then, after cooling to ambient temperature overnight, they were subjected to several tests designed to show resistance to crystallization when homogenized: ambient gassing and mixing with ANFO, ambient gassing and mixing with microballoons, ambient stress mixing concurrent with viscosity measurement, and an AN stability test that consisted in mixing the emulsion with 50 percent KT AN prill and monitoring for crystallization. The ungassed emulsion matrix also was stored at ambient temperatures. Table 3 shows that in each instance an improvement in stability was observed when an animal oil homogenization additive was present.

EXAMPLE 3

Table 4 contains examples of emulsions produced in a continuous process. Hot oxidizer salt solution was mixed with hot organic liquid fuel in a blender containing rotors and stators and the resulting emulsion was cooled to ambient temperature, repumped twice and then subjected to homogenization through a high shear valve at 300 psi back pressure while mixing with microballoons. Formulation 1 contained 10 percent SMO in the fuel phase while Formulation 2 contained 10 percent tall oil of approximately 95 percent fatty acid content. Samples of each formulation were collected before and after homogenization and prior to mixing with microballoons. A viscosity increase of 9.6 times and 12.5 times was observed for Formulations 1 and 2, respectively, with little crystallization. These samples were monitored over time and found to have similar storage stability, although Formulation 2 exhibited better storage stability following homogenization. These formulations also were detonated and found to have similar detonation properties as shown in Table 4.

EXAMPLE 4

Further examples of emulsions produced through a continuous process are illustrated in Table 5. In these examples, 10% of the organic liquid fuel was substituted by either SMO or animal oil. The emulsions were formed similarly to those in Example 3 and then immediately gassed, homogenized, and blended with ANFO. Viscosity increases of 4.4 and 5.6 times were observed for the SMO and animal oil homogenized formulations, respectively. Table 5 shows similar detonation results for the two formulations, but a significant improvement is shown in the storage stability of the homogenized emulsion containing animal oil.

While the present invention has been described with reference to certain illustrative examples and preferred embodiments, various modifications will be apparent to those skilled in the art and any such modifications are intended to be within the scope of the invention as set forth in the appended claims.

TABLE 1

Qualitative Stability Grading Scale

| Grade | Degree of Crystallization |
|---|---|
| N | None |
| VS | Very Slight |
| S | Slight |
| SM | Slight to Moderate |
| M | Moderate |
| MH | Moderate to Heavy |
| H | Heavy |
| VH | Very Heavy |

TABLE 2

Comparison of SMO, Vegetable Oil, Tall Oil (56% Fatty Acids) and Animal Oil

| | 1 | 2 | 3 | 4 | 5 | 6 |
|---|---|---|---|---|---|---|
| AN | 77.60 | 77.60 | 77.60 | 77.60 | 77.60 | 77.60 |
| $H_20$ | 15.90 | 15.90 | 15.90 | 15.90 | 15.90 | 15.90 |
| Mineral Oil | 5.66 | 5.33 | 5.33 | 5.33 | 5.33 | 5.33 |
| Polymeric Emulsifier | 0.84 | 0.84 | 0.84 | 0.84 | 0.84 | 0.84 |
| SMO (sorbitan monooleate) | — | 0.33 | — | — | — | — |
| Corn Oil | — | — | 0.33 | — | — | — |
| Tall Oil[1] | — | — | — | 0.33 | — | — |
| Tallow Oil[2] | — | — | — | — | 0.33 | — |
| Lard Oil[3] | — | — | — | — | — | 0.33 |

TABLE 2-continued

Comparison of SMO, Vegetable Oil, Tall Oil (56% Fatty Acids) and Animal Oil

| | 1 | 2 | 3 | 4 | 5 | 6 |
|---|---|---|---|---|---|---|
| Homogenization Results | | | | | | |
| Temperature Rise (° C.) | +17.1 | +3.1 | +3.8 | +2.4 | +3.0 | +0.9 |
| Crystallization | Heavy | None | Very Slight | None | None | None |
| Viscosity (cP x 1000)[4] | | | | | | |
| Before | 32.2 | 35.6 | 28.8 | 30.4 | 28.4 | 30.4 |
| After | 110.2 | 122.0 | 118.8 | 130.0 | 122.4 | 112.8 |
| Stability Results[5] | | | | | | |
| Non-homogenized | | | | | | |
| Storage Weeks | | | | | | |
| 0 | N | N | N | N | N | N |
| 6 | N | N | N | N | N | N |
| 12 | N | VS | VS | S | N | N |
| 18 | N | SM | MH | VH | N | N |
| Homogenized | | | | | | |
| Storage Weeks | | | | | | |
| 0 | MH | N | VS | N | N | N |
| 6 | MH | SM | S | VS | N | N |
| 12 | H | H | M | SM | N | N |
| 18 | VH | VH | VH | VH | N | N |

[1]Sylvatal D40T (~56% fatty acids content) from Arizona Chemical.
[2]Low Pour Acidless Tallow Oil from Geo. Pfau's Sons Company, Inc.
[3]Special Prime Burning Lard Oil from Geo Pfau's Sons Company, Inc.
[4]Measured with an HA model Brookfield digital viscometer using a #7 spindle at 20 rpm.
[5]Qualitative grading scheme (see Table I).

TABLE 3

Stability of Pre-Homogenized Emulsion with Animal Oil

| | 1 | 2 | 3 |
|---|---|---|---|
| AN | 76.14 | 76.14 | 76.14 |
| $H_2O$ | 17.49 | 17.49 | 17.49 |
| Mineral Oil | 1.80 | 1.80 | 1.80 |
| Fuel Oil | 3.66 | 3.42 | 3.42 |
| Polymeric Emulsifier | 0.54 | 0.48 | 0.48 |
| Lard Oil[1] | — | 0.30 | — |
| Tallow Oil[2] | — | — | 0.30 |
| Gassing Agents | 0.37 | 0.37 | 0.37 |
| Stability Results[3] | | | |
| Ambient Storage (Ungassed) | | | |
| 1 Day | VS | VS | N |
| 3 Weeks | S | VS | VS |
| 6 Weeks | SM | VS | S |
| Ambient Gassing + 35% ANFO | | | |
| 1 Day | MH | SM | SM |
| 3 Weeks | H | H | H |
| 6 Weeks | VH | H | H |
| Ambient Gassing + 3% Glass microballoons | | | |
| 1 Day | N | N | N |
| 3 Weeks | S | SM | SM |
| 6 Weeks | H | M | M |
| Ambient Stressing[4] (Viscosity in cP × 1000)[5] | | | |
| 1 Day | VS (17.8) | VS (16.6) | N (17.2) |
| 3 Weeks | MH (21.1) | VS (21.7) | S (22.6) |
| 6 Weeks | MH (—)[6] | SM (30.3) | S (29.4) |

TABLE 3-continued

| Stability of Pre-Homogenized Emulsion with Animal Oil | 1 | 2 | 3 |
|---|---|---|---|
| AN Stability Test[7] | | | |
| 1 Day | MH | VS | VS |
| | (+2.6) | (+0.3) | (+0.2) |
| 3 Weeks grade | H | M | M |
| 6 Weeks grade | H | MH | MH |

[1]No. 1 Lard Oil from Geo Pfau's Sons Company Inc.

[2]Acidless Tallow Oil from Geo. Pfau's Sons Company Inc.

[3]Qualitative grading scheme (see Table I).

[4]Emulsion stressed weekly at 500 rpm for two minutes.

[5]Viscosity measured initially (1 day) and then weekly before stress mixing with an HA Brookfield digital viscometer using a #7 spindle at 20 rpm.

[6]Weekly stressing terminated because of high degree of crystallization.

[7]Emulsion mixed with 50% KT prill and then monitored for crystallization.

TABLE 4

| SMO and Tall Oil (95% Fatty Acid) Comparison | 1 | 2 |
|---|---|---|
| AN | 64.98 | 64.98 |
| SN | 12.16 | 12.16 |
| H2O | 16.36 | 16.36 |
| Mineral Oil | 2.25 | 2.25 |
| Fuel Oil | 2.25 | 2.25 |
| Polymeric Emulsifier | 0.90 | 0.90 |
| SMO | 0.60 | — |
| Tall Oil[1] | — | 0.60 |
| Microballoons | 0.50 | 0.50 |
| Results | | |
| Viscosity (cP × 1000)[2] | | |
| Before Homogenization | 23.0 | 20.0 |
| After Homogenization | 220.0 | 250.0 |
| Density (g/cc) | 1.18 | 1.18 |
| MB, 100 mm, Det/Fail | 2 g/- | 2 g/- |
| D, (km/s) | | |
| 75 mm | 5.5 | 5.7 |
| 32 mm | 5.3 | 5.2 |
| 25 mm | 5.1 | 5.0 |
| Stability[3] (Storage weeks) | | |
| Before Homogenization | | |
| 0 | N | N |
| 4 | VS | VS |
| 8 | VS | VS |
| 12 | S | VS |
| 16 | M | SM |
| After Homogenization | | |
| 0 | N | N |
| 4 | S | S |
| 8 | S | M |
| 12 | H | H |

[1]Sylfat FA2 (~95% fatty acid content) from Arizona Chemical.

[2]Measured with an HA Brookfield digital viscometer using a #7 spindle at 20 rpm.

[3]Qualitative grading scheme (see Table I).

TABLE 5

| SMO Animal Oil Comparison | 1 | 2 |
|---|---|---|
| AN | 38.80 | 38.80 |
| $H_2O$ | 7.90 | 7.90 |
| Mineral Oil | 1.22 | 2.51 |
| Fuel Oil | 1.22 | — |
| Polymeric Emulsifier | 0.49 | 0.42 |
| SMO | 0.32 | — |
| Lard Oil[1] | — | 0.32 |
| Gassing Agents | 0.85 | 0.85 |
| ANFO | 49.20 | 49.20 |
| Results | | |
| Viscosity (cP × 1000)[2] | | |
| Before Homogenization | 23.2 | 27.2 |
| After Homogenization | 102.8 | 151.4 |
| Density (g/cc) | 1.13 | 1.10 |
| MB, 150 mm, Det/Fail | 2 g/#12 | 12 g/6 g |
| D, 3C (km/s) | | |
| 150 mm | 4.0 | 4.3 |
| 125 mm | 4.0 | 4.0 |
| 100 mm | 3.9 | 3.6 |
| 75 mm | 3.5 | 3.5 |
| Stability After Homogenization[3] | | |
| Storage Weeks | | |
| 0 | N | N |
| 5 | SM | VS |
| 11 | VH | S |
| 14 | VH | SM |

[1]Special Prime Burning Lard Oil from Geo Pfau's Sons Company Inc.

[2]Measured with an HA Brookfield digital viscometer using a #7 spindle at 20 rpm.

[3]Qualitative grading scheme (see Table I).

What is claimed is:

1. A method for forming an homogenized, polymeric emulsifier-based emulsion phase having improved stability comprising:

(a) fanning an inorganic oxidizer salt solution, (b) forming an organic fuel phase which comprises at least about 3% by weight of the fuel phase of an animal oil as an homogenization additive, (c) mixing the organic fuel phase and the inorganic oxidizer salt solution phase in the presence of a polymeric emulsifier with sufficient shear to form the emulsion phase, (d) cooling or allowing the emulsion phase to cool below the crystallization temperature of the inorganic oxidizer salt solution, and thereafter (e) homogenizing the emulsion phase by subjecting it to high shear conditions sufficient to at least double its viscosity, whereby the combination of homogenization additive and polymeric emulsifier imparts improved stability to the homogenized emulsion phase.

2. A method according to claim 1 wherein the organic fuel phase is present in an amount of from about 3% to about 12% by weight of the emulsion phase.

3. A method according to claim 2 wherein the homogenization additive is present in the amount of from about 3% to about 40% by weight of the organic fuel phase.

4. A method according to claim 1 wherein the animal oil is rendered from animal fats.

5. A method according to claim 4 wherein the animal oil is selected from the group consisting of lard oil, tallow oil and poultry oil.

6. A method for homogenizing a polymeric emulsifier-based emulsion phase comprising:

(a) forming an inorganic oxidizer salt solution, (b) forming an organic fuel phase which comprises at least about 3% by weight of the fuel phase of a fatty acid as an homogenization additive, (c) mixing the organic fuel phase and the inorganic oxidizer salt solution phase in the presence of a polymeric emulsifier with sufficient vigor to form the emulsion phase having a pH of from about 2.0 to about 5.0, (d) cooling or allowing the emulsion phase to cool below the crystallization temperature of the inorganic oxidizer salt solution, and thereafter (e) homogenizing the formed emulsion phase by subjecting it to high shear conditions sufficient to at least double its viscosity, whereby the combination of homogenization additive and polymeric emulsifier imparts improved stability to the homogenized emulsion phase.

7. A method according to claim 6 wherein the organic fuel phase is present in an amount of from about 3% to about 12% by weight of the emulsion phase.

8. A method according to claim 7 wherein the homogenization additive is present in the amount of from about 3% to about 40% by weight of the organic fuel phase.

9. A method according to claim 6 wherein the fatty acids are derived from the hydrolysis of glycerol esters.

10. A method according to claim 6 wherein the viscosity of the emulsion phase is increased from about 3 to 10 times.

* * * * *

UNITED STATES PATENT AND TRADEMARK OFFICE

CERTIFICATE OF CORRECTION

PATENT NO. : 6,808,573 B2 
DATED : October 26, 2004
INVENTOR(S) : Richard H. Hales et al.

It is certified that error appears in the above-identified patent and that said Letters Patent is hereby corrected as shown below:

Column 10,
Line 40, "fanning" should be changed to -- forming --.

Signed and Sealed this

Twenty-fifth Day of October, 2005

JON W. DUDAS
*Director of the United States Patent and Trademark Office*